US006076323A

United States Patent [19]

Chiu

[11] Patent Number: 6,076,323

[45] **Date of Patent: *Jun. 20, 2000**

[54] RAPIDLY ASSEMBLED WALLS AND COLUMNS

[76] Inventor: Fu Sung Chiu, 5F, No. 30, Jiann Chung St., Hualien City, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 09/042,501

[22] Filed: Mar. 17, 1998

[51] Int. Cl.[7] ..... E04B 1/08

[52] U.S. Cl. ..... 52/562; 52/479; 52/481.1; 52/489.1; 52/239; 52/664

[58] Field of Search ..... 52/562, 479, 481.1, 52/489.1, 239, 481.2, 664, 665, 667, 745.09

[56] References Cited

U.S. PATENT DOCUMENTS

| | | | |
|---|---|---|---|
| Re. 28,976 | 9/1976 | Zinn | 52/747 |
| Re. 29,965 | 4/1979 | Zinn | 52/243 |
| 1,348,009 | 7/1920 | Jester | 52/489.1 |
| 1,759,070 | 5/1930 | Tengstedt | 52/562 |
| 2,061,281 | 11/1936 | Lawlor | 189/34 |
| 2,076,728 | 4/1937 | Keller | 189/34 |
| 2,150,459 | 3/1939 | Reintjes | 72/101 |
| 2,605,865 | 8/1952 | Liptay | 189/34 |
| 3,019,863 | 2/1962 | Kearns, Jr. | 189/34 |
| 3,101,817 | 8/1963 | Radek | 52/481.2 X |
| 3,478,480 | 11/1969 | Swenson | 52/396 |
| 4,517,780 | 5/1985 | Lacombe | 52/233 |
| 4,793,113 | 12/1988 | Bodnar | 52/481 |
| 4,905,428 | 3/1990 | Sykes | 52/239 X |
| 4,967,528 | 11/1990 | Doran | 52/309.12 |
| 4,987,719 | 1/1991 | Goodson, Jr. | 52/745.09 |
| 5,069,263 | 12/1991 | Edwards | 52/239 X |
| 5,107,648 | 4/1992 | Roby | 52/309.12 |
| 5,452,556 | 9/1995 | Taylor | 52/730.7 |
| 5,487,246 | 1/1996 | Hodges et al. | 52/239 X |
| 5,566,518 | 10/1996 | Martin et al. | 52/426 |
| 5,642,593 | 7/1997 | Shieh | 52/239 |
| 5,740,650 | 4/1998 | Seiber et al. | 52/239 X |
| 5,867,955 | 2/1999 | Russell | 52/239 X |
| 5,956,922 | 9/1999 | Liuska | 52/745.09 |

FOREIGN PATENT DOCUMENTS

| | | | |
|---|---|---|---|
| 402108749 | 4/1990 | Japan | 52/745.09 |
| 1223751 | 3/1971 | United Kingdom | 52/562 |

*Primary Examiner*—Carl D. Friedman
*Assistant Examiner*—Phi Dieu Tran A
*Attorney, Agent, or Firm*—Bacon & Thomas

[57] ABSTRACT

Disclosed herein are rapidly assembled walls and columns, wherein the walls and columns are made of wasted wooden material, wood, marble, lime stone, tile, compressed stone powder FRP, glass, calcium silicate plate, while the inner components are made of metals as steel, stainless steel, and aluminum alloy, and reinforced plastics, carbon fiber and fire-proof plastics.

The method of assembling rapidly assembled walls and columns comprises A, B, C, D and E five assembly modes, these modes are commonly characterized by applying an idea of exquisite, simple and progressive through making use of wooden block principle. Every person who is an amateur in construction work can construct his own house in DIY way according to the steps illustrated and using materials provided in the present invention. The products made of the present invention may be used as inner and outer walls, columns, interior decoration, landscaping articles, sound isolation member, security fence and ceiling.

Moreover, the re-use of wasted materials makes a contribution to environmental protection and beautification, the re-use of wasted materials also serves to reduce the cost of materials and construction.

4 Claims, 16 Drawing Sheets

RAPIDLY ASSEMBLED WALLS AND COLUMNS

BACKGROUND OF THE INVENTION

1. Filed of the Invention

The present invention relates to rapidly assembled walls and columns, and more particularly, to walls and columns containing five types of assembly modes. The products of the present invention is exquisite, simple convenient and practical that the walls and columns can be assembled at any place according to the user's desire.

2. Brief Description Of The Prior Art

The architectural construction such as, room partition, inner and outer walls, columns, and sound insulation walls are even popularly known to people who are amateurs in architecture.

Conventional steel reinforced concerts walls and red brick or hollow brick walls are advantageously firm enough, yet tedious repeated process required during the construction work results in environmental contamination as well as entailing noise.

A rather newly developed construction technique of prefabricated members such as curtain walls and columns is considered applicable for its easy management, but its high material cost has obstructed its development.

Other newly developed construction materials such as lime board, calcium silicate pannel board and corrugated steel sheet are versatile in usage, but the unfirm hollow construction has limited their further development for ranking to essential architectural construction materials.

The inventor of the present invention previously invented "Rapid and Firm Brick Assembly" and patented by the R.O.C. Patent No. Z19424330.0, wherein the construction material according to the invention made a great improvement for rectifing common shortcomings of red bricks, hollow bricks and ALC bricks. "Large Wall Pannel Assembly", patented by the R.O.C. Patent No. ZL 95223888.3, wherein a new product was disclosed for replacing disadvantageously thick and heavy, product of conventional prefabricate wall member so as to obviate the inconvenience of grouting concrete at a construction site located in a congested district, or far away suburban areas, and to save buffing or painting the surface of the prefabricated walls necessary for the conventional products. An improved product, patented by the R.O.C. Patent No. ZL 95223889.6, is replaceable for high cost curtain walls constructed of steel skeleton structure and conventional hollow unfirm lime board, calciums silicate panel board and the like. Rapidly assembled walls and columns of the present invention show one step advanced novelty, availability and popularity. Its construction techniques are quite different from those of previous inventions described above in which including (a) inner and outer wall engagement, (b) forms of component parts, (c) methods and techniques of assembly.

SUMMARY OF THE INVENTION

It is a first object of the present invention to provide rapidly assembled walls and columns which are low cost, high quality, and firm construction materials, able to be rapidly assembled to shorten required working time which leads to minimizing environmental contamination and noise.

It is a second object of the present invention to provide rapidly assembled walls and columns wherein inner and outer wall materials and all of the component parts can be made in respective specialized work shop in the way of mass production by moulding.

It is a third object of the present invention to provide rapidly assembled walls and columns so exquisite, convenient and practical able to be assembled at any desired place by an amateur user in architecture in DIY way.

To achieve these and other objects, the materials employed in the present invention can be easily purchased from the markets and the user may assign the dimension of inner and outer walls freely. Wooden materials may be formed of waste wood, other materials for example, compressed marble powder, limestone, tiles, metal plates formed of steel, aluminum, stainless steel, pannels and boards formed of wood, FRP, Glass and calcium silicate etc. are all available.

As for inner component parts, various materials with high tension and compressive strength, for example, steel, aluminum alloy and other metals, carbon fiber and fire-proof plastics etc. are all available.

In addition, inner cavity between the inner and outer walls and columns can be used to lay horizontal and vertical steel bars or to provide passages for electric and water conduits. If waste marble powder is filled in the above mentioned cavity, it can serve a good sound isolation effect and enhance the strength of walls and columns as well.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBROILMENT

Figure 1:
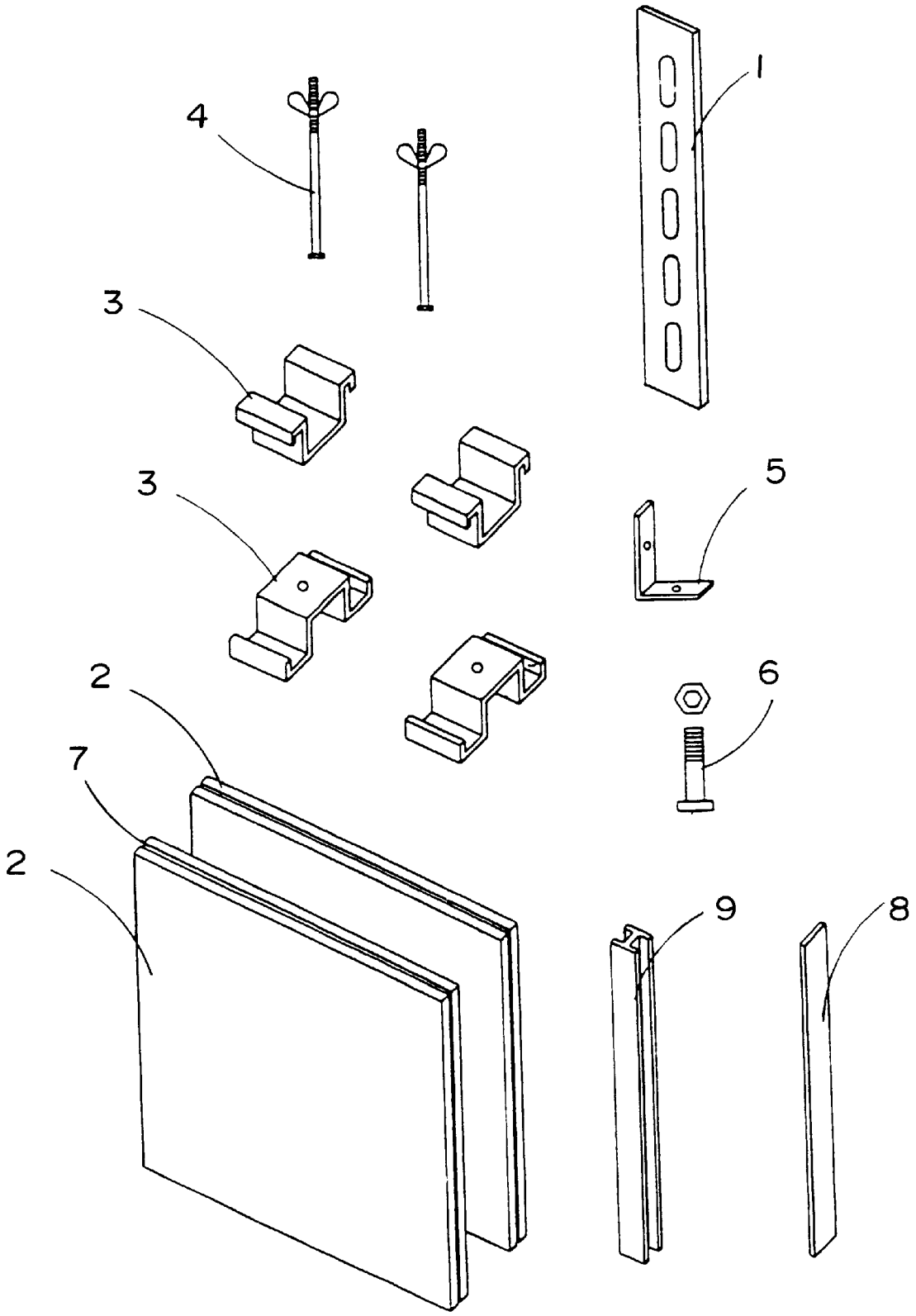
FIG. 1 is a drawing of each component part in A type assembly mode of the present invention.
Figure 2:
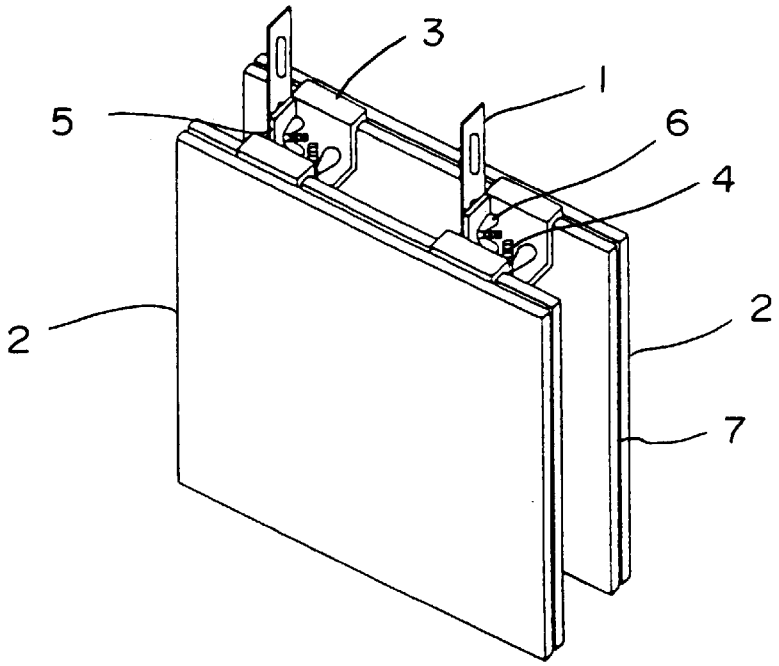
FIG. 2 is a drawing of A type assembly mode of the present invention in which all components have been assembled before grouting mortar.
Figure 3:
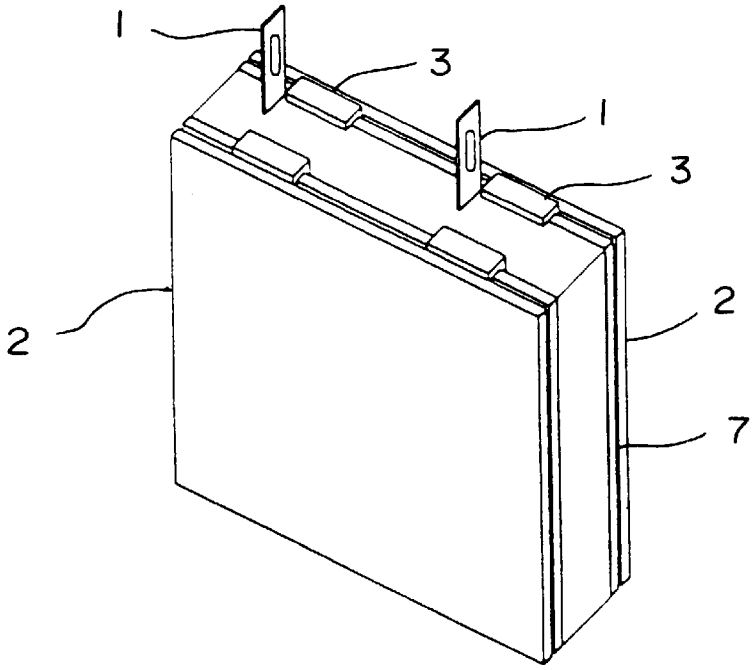
FIG. 3 is drawing of A type assembly mode of the present invention after completion of both assembly and grouting mortar in its inner cavity.
Figure 4:
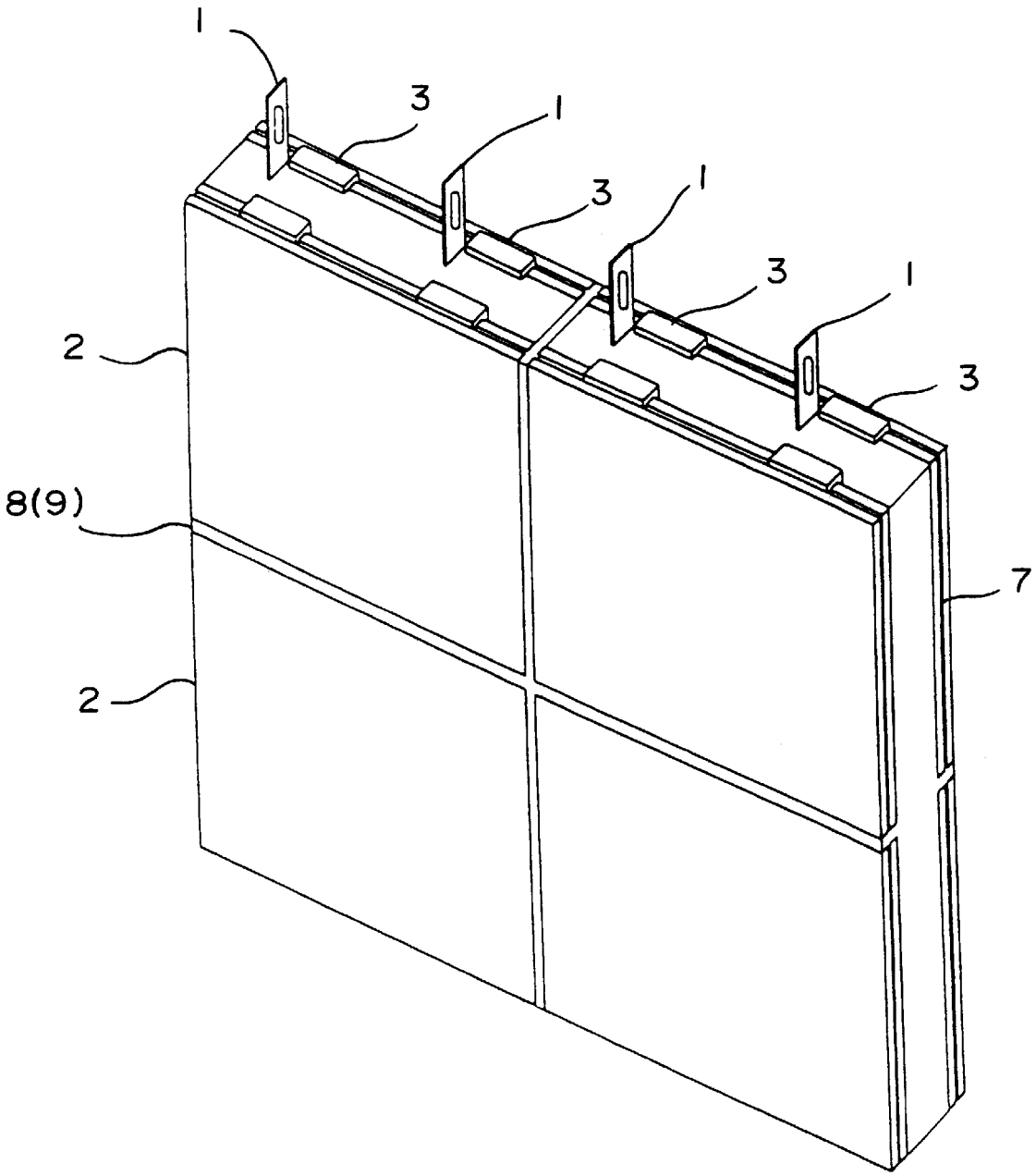
FIG. 4 is a drawing of a wall assembly according to A type assembly mode of the present invention.
Figure 5:
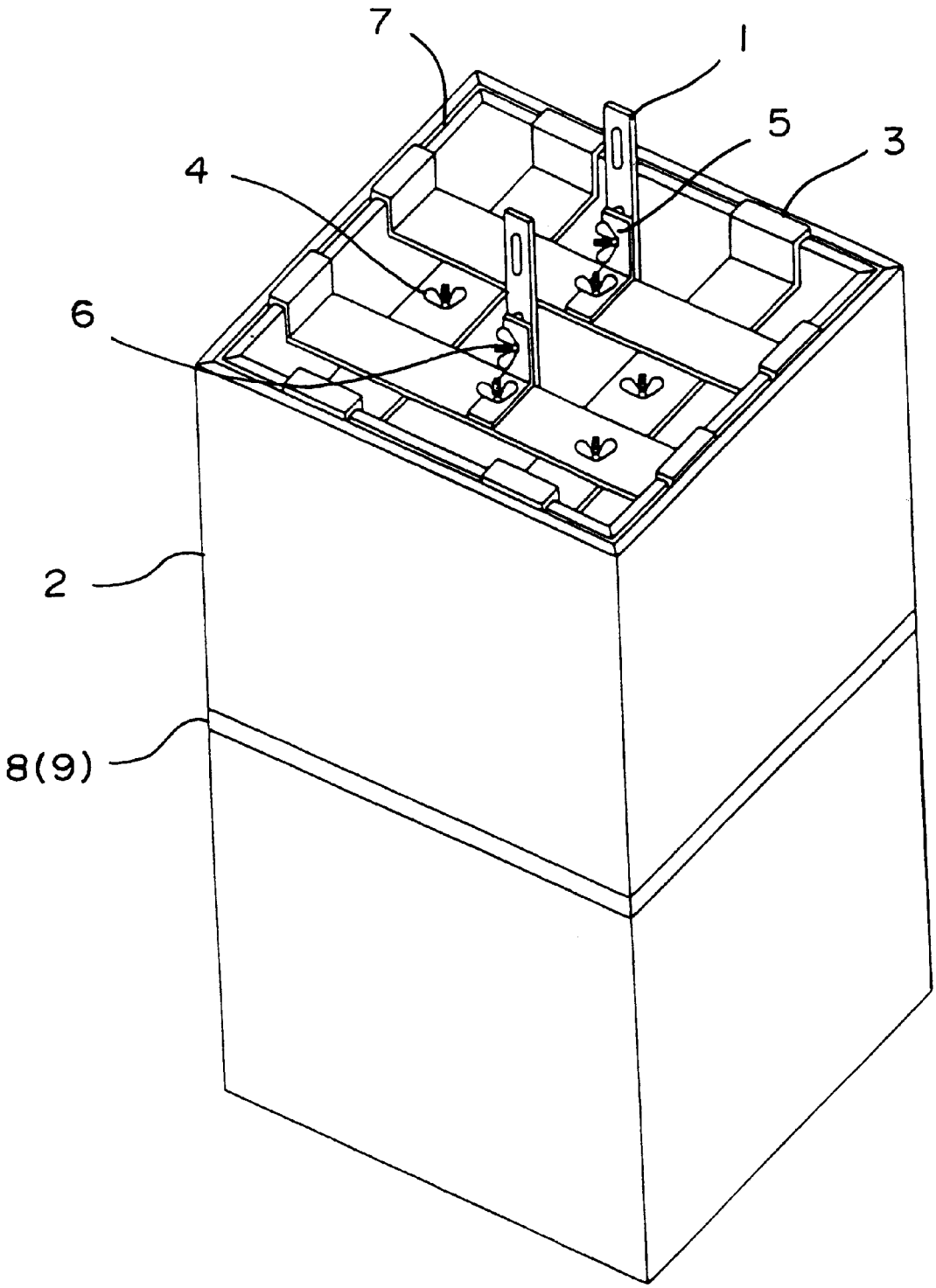
FIG. 5 is a drawing of a column assembled according to A type assembly mode of the present invention.
Figure 6:
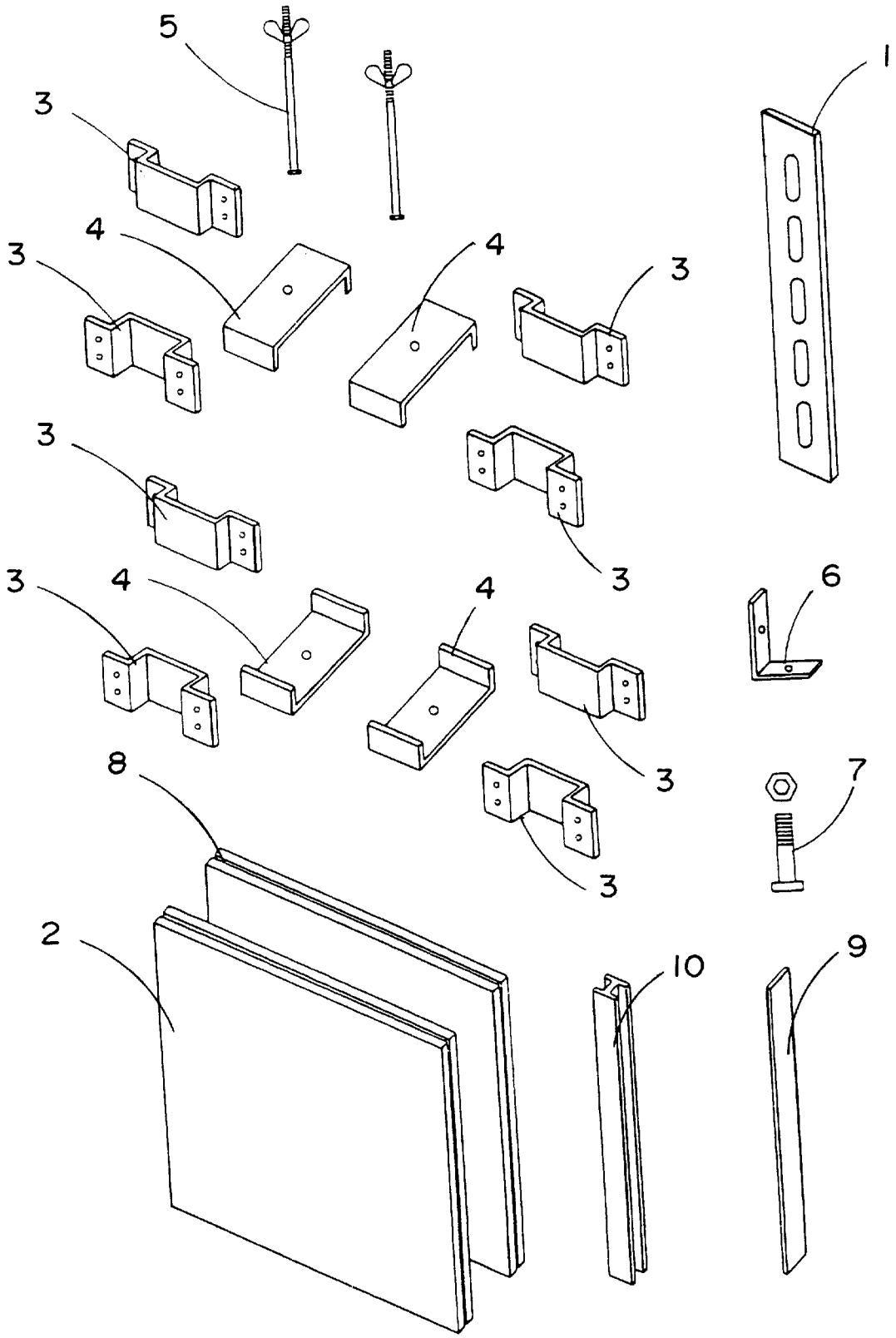
FIG. 6 is a drawing of each component part in B type assembly mode of the present invention.
Figure 7:
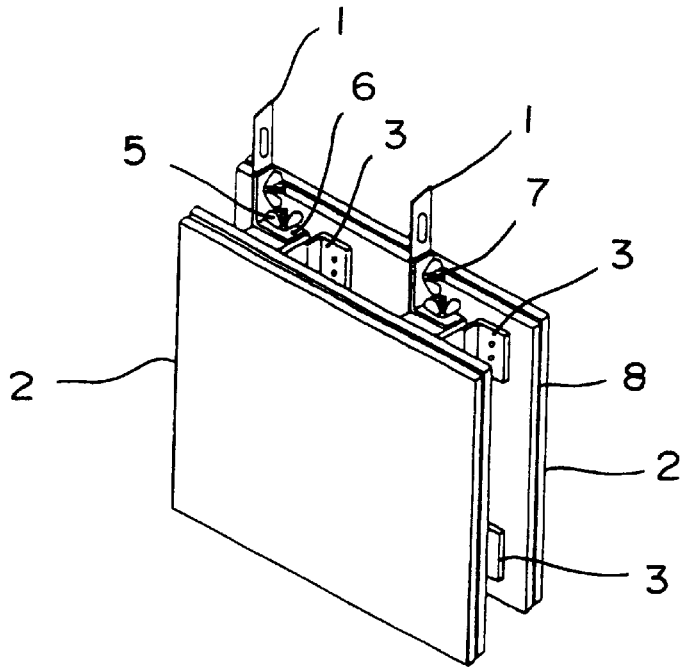
FIG. 7 is a drawing of A type assembly mode of the present invention in which all components have been assembled before grouting mortar.
Figure 8:
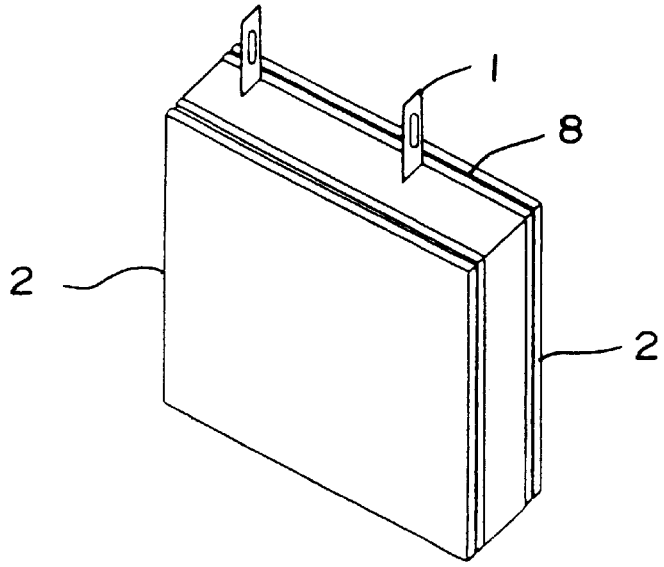
FIG. 8 is a drawing of B type assembly mode of the present invention after completion of both assembly and grouting mortar in its inner cavity.
Figure 9:
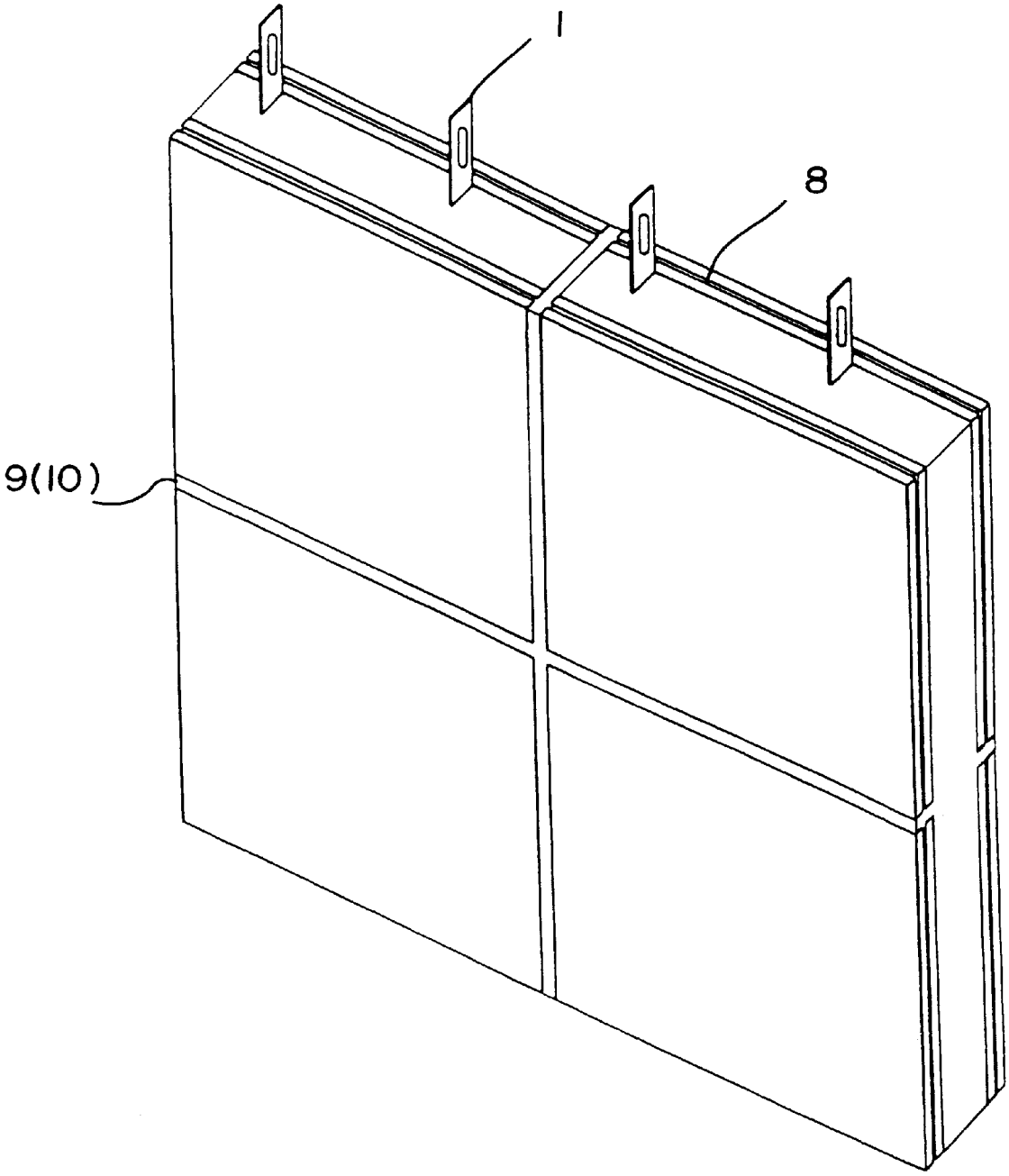
FIG. 9 is a drawing of a wall assembly according to B type assembly mode of the present invention.
Figure 10:
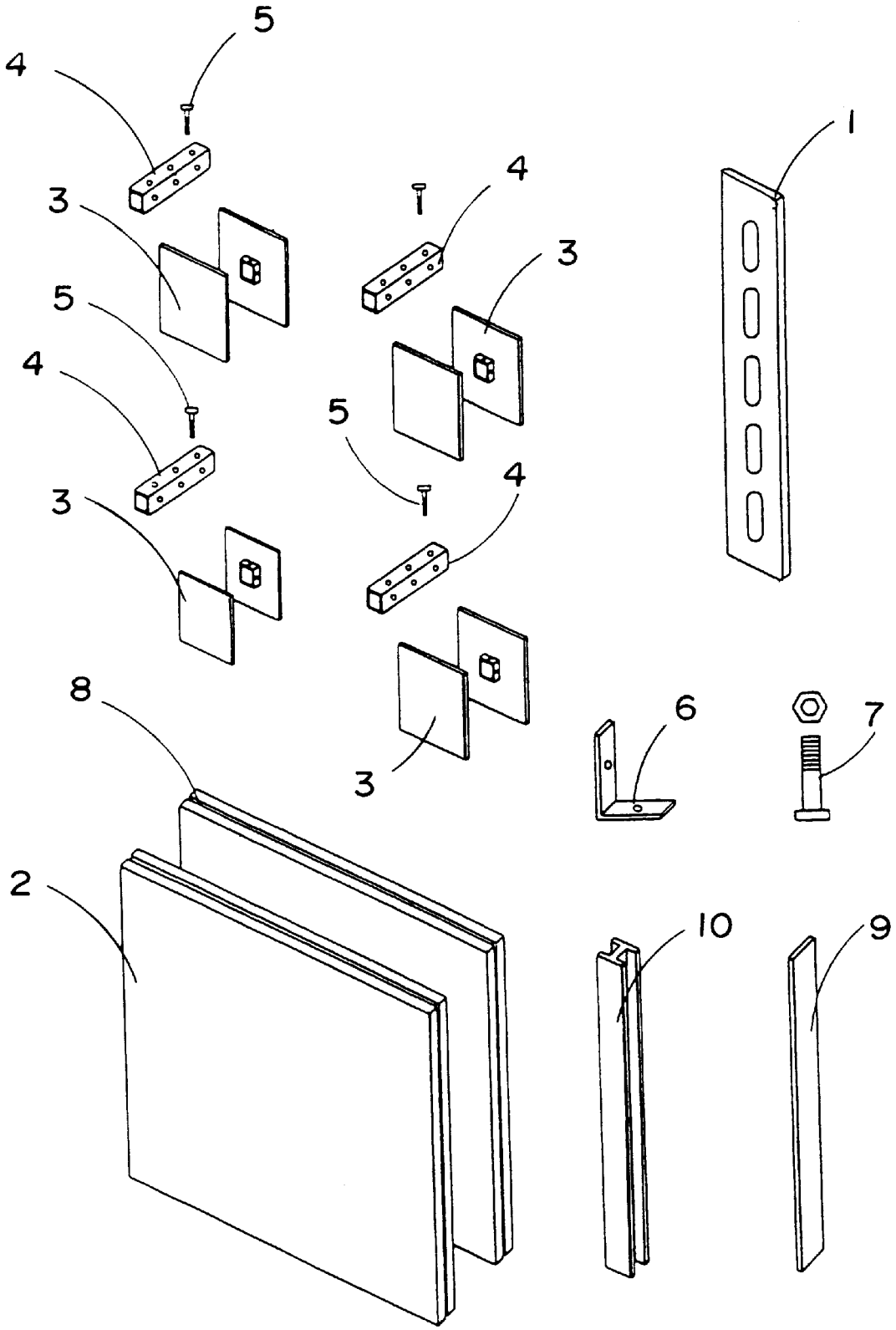
FIG. 10 is a drawing of each component part in C type assembly mode of the present invention.
Figure 11:
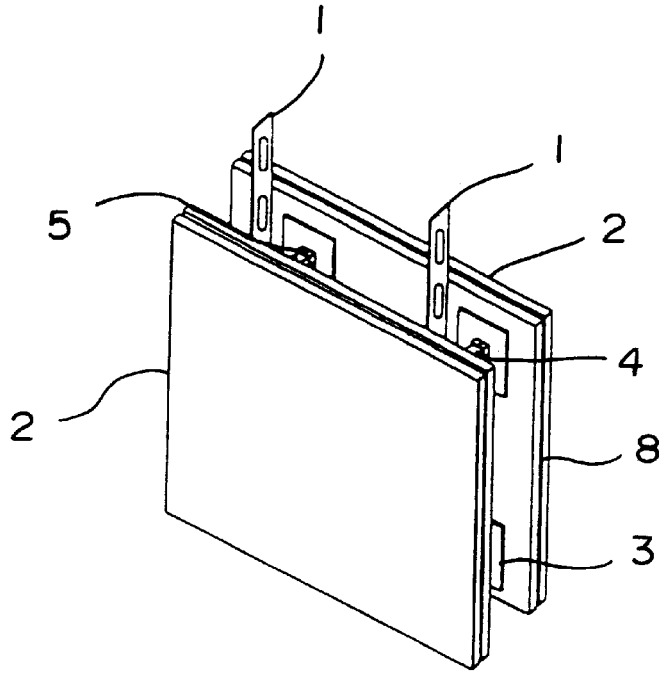
FIG. 11 is a drawing of C type assembly mode of the present invention in which all components have been assembled before grouting mortar.
Figure 12:
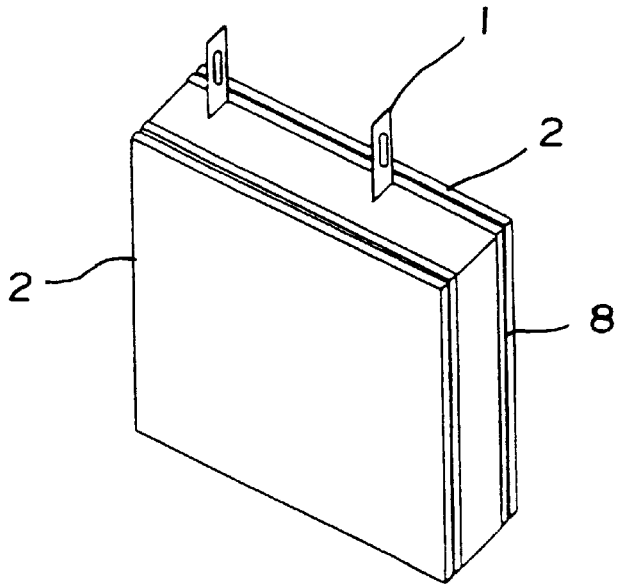
FIG. 12 is a drawing of C type assembly mode of the present invention after completion of both assembly and grouting mortar in its inner cavity.
Figure 13:
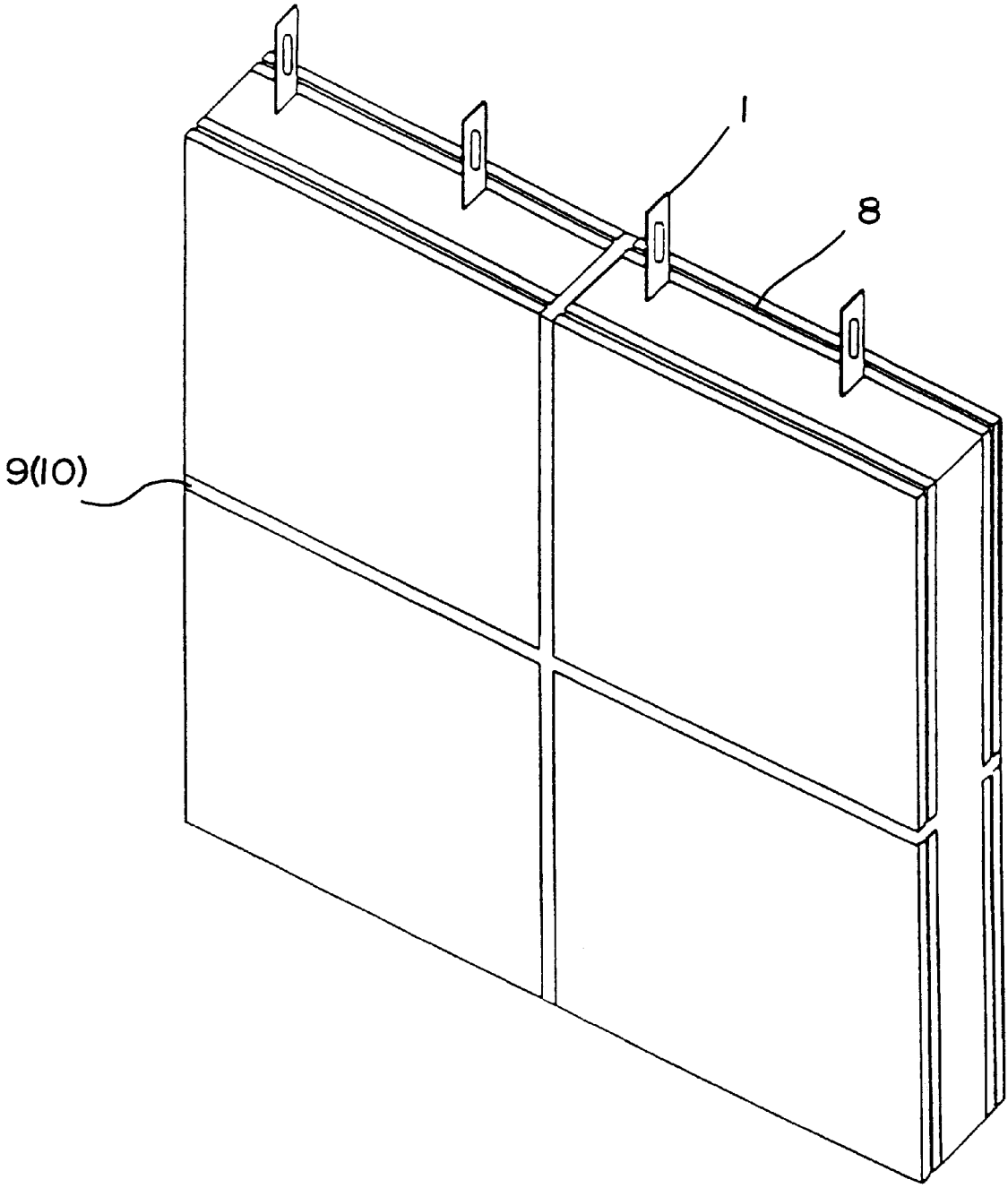
FIG. 13 is a drawing of a wall assembly according to C type assembly mode of the present invention.

A type assembly mode:

Referring to FIGS. 1 through 3, in A assembly mode of the rapidly assembled walls and columns comprises a fixed column 1, inner and outer wall pannels 2, a plurality of clamping jaws 3, a plurality of long screws and nuts 4, a plurality of L shaped components 5, a plurality of short screws and nuts 6, a joint groove 7, a plurality of flat strips 8, and a plurality of H-bars 9, to be assembled to form a wall body. As shown in FIG. 1, the steps of assembly include: engaging the joint grooves 7 of the inner and outer wall panels 2 by hooks 3 formed at upper and lower ends of the clamping jaws 3; then afterwards using a plurality of long screws and nuts 4 to bind the two wall pannels forcibly together by inserting a long screw through a hole provided for each clamping jaw 3 and fastening the nut until the two pieces of wall pannel are firmly fixed together, then attaching on end of the L shaped components 5 to the protruded portion of the long screws, while securing and fixing the other end of each L shaped component 5 to the fixed column 1 for further enhancing the structure of the wall assembly; and filling a plurality of flat strips 8 or H-bars 9 around the circumference of the joint groove 7 in order to prevent leaking of grouted mortar. The structural unit assembled according to the above described mode can be successively joined together as many units as required.

B type assembly mode:

Referring to FIGS. 6 through 9, most of the component parts in A type assembly mode can be used except the configuration of clamping Jaw 3 is changed to have a flat plate at its both ends, and is added extension members 4 with hooks provided at their both ends as component parts. The steps of assembly include: attaching the two flat plates at both ends of each clamping jaw 3 to the back surfaces of inner and outer wall pannels; engaging the two hooks of each extension member to the holes of the clamping jaw; and using long screws and nuts to bind the two wall pannels firmly together. The successive steps hereinafter are similar to those described in A mode.

C type assembly mode:

Referring to FIGS. 10 through 13, most of the components parts in A type can be utilized except the configuration of the clamping jaw 3 is changed to a square hollow tube weld with a steel plate, and the configuration of the extension member 4 is replaced by a square long tube, besides, a plurality of male screw 5 are added. The steps of C type assembly mode include: attaching the steel plate of the clamping jaws 3 flatly on the back surfaces of the inner and outer wall panels 2; inserting the tube outlet of the extension members 4 between two wall pannels; and then tightening the assembled unit with the male screws 5, the rest steps are similar to those described in A assembly mode.

Figure 14:
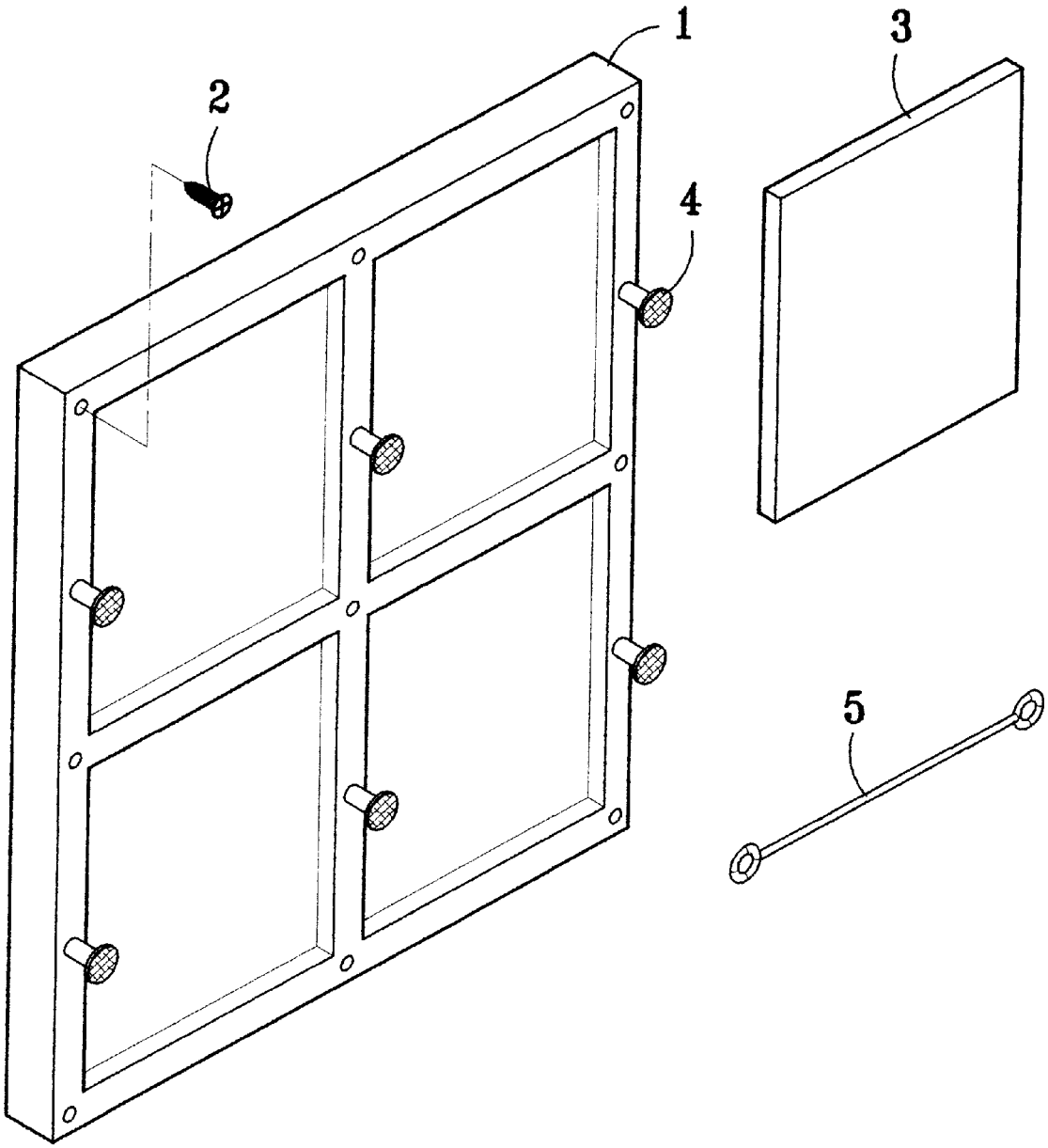
FIG. 14 is a drawing of each component part in D type assembly mode of the present invention.
Figure 15:
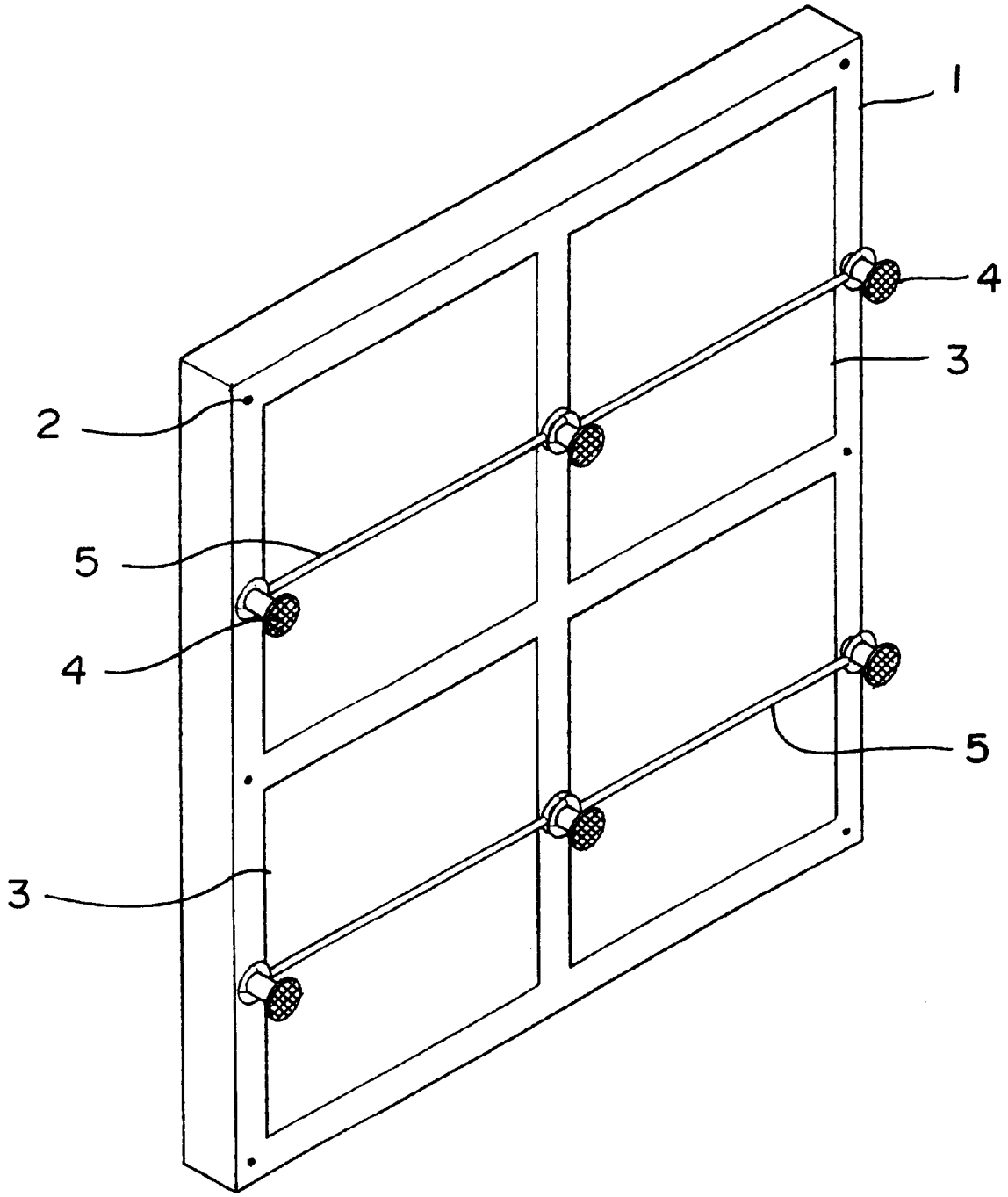
FIG. 15 is a drawing of D type assembly mode of the present invention in which all components have been assembled before grouting mortar.
Figure 16:
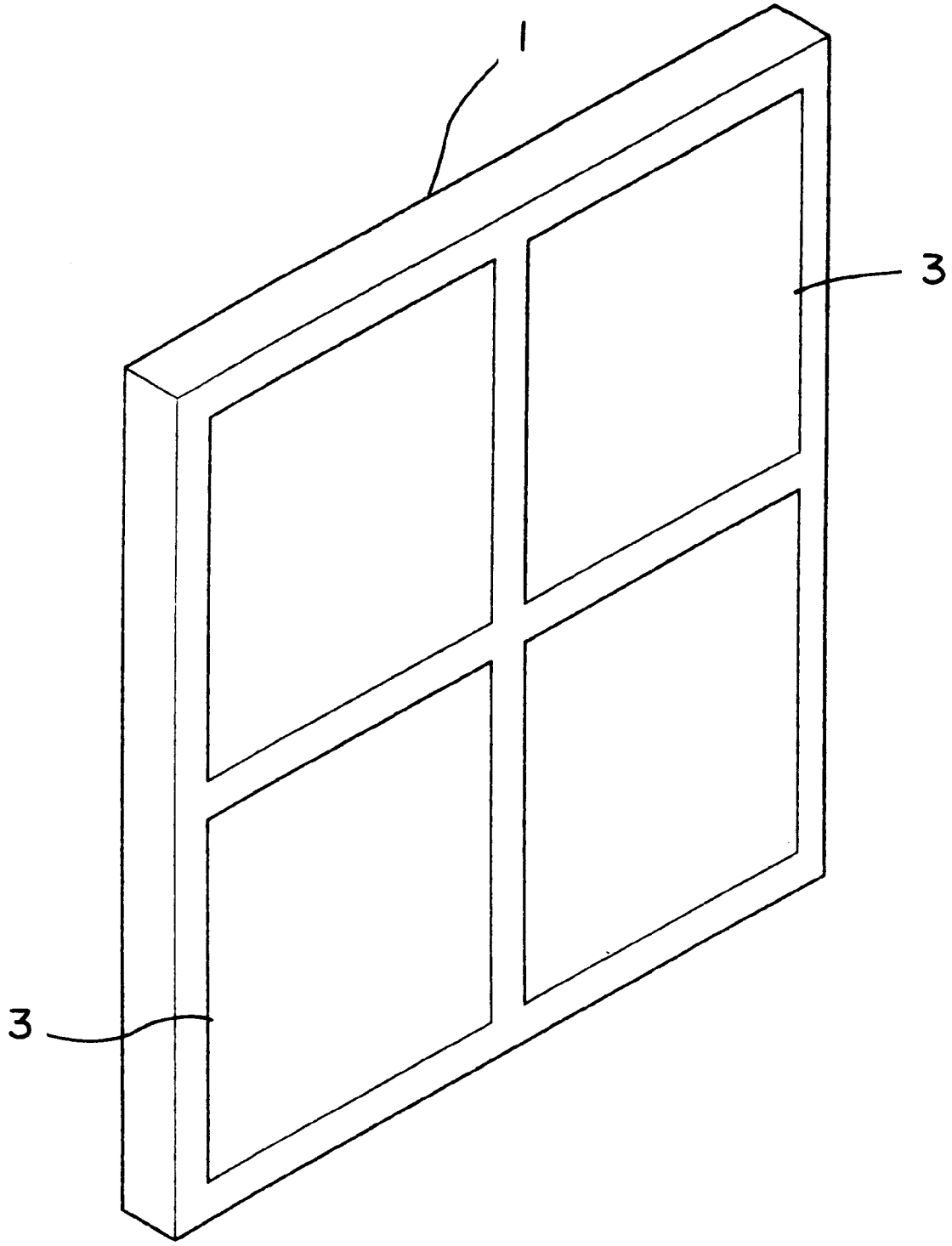
FIG. 16 is a drawing of D type assembly mode of the present invention after completion of assembly, grouting and detaching forms.

D type assembly mode:

Referring to FIGS. 14 through 16, the entire assembly unit comprises a plurality of square frame 1, a plurality of fastening screw 2, a plurality of wall pannels 3, a plurality of fixing claws 4 and engaging strips 5 for fastening the wall panels.

As shown in FIG. 14, the steps of D type assembly mode include: fixing the square frames 1 on wooden forms with the fastening screws 2; setting each wall pannel 3 in respective square frame 1; fixing the wall pannels 3 to the square frames 1 by engaging the fixing claw 4 with strips 5; grouting mortar; and detaching the wooden forms to accomplish forming of a wall, column, or ceiling unit.

Figure 17:
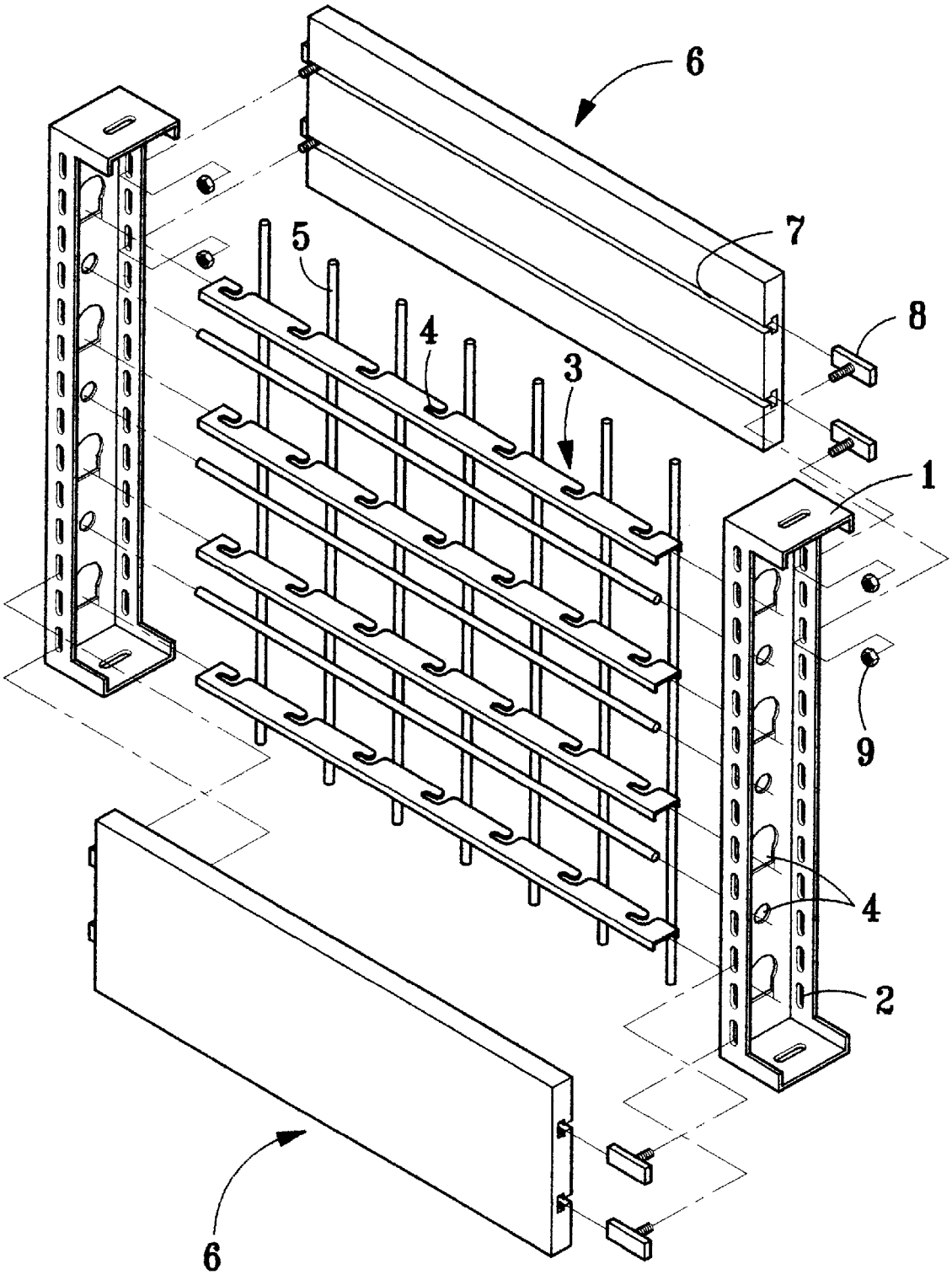
FIG. 17 is a drawing of each component part in E type assembly mode of the present invention.
Figure 18:
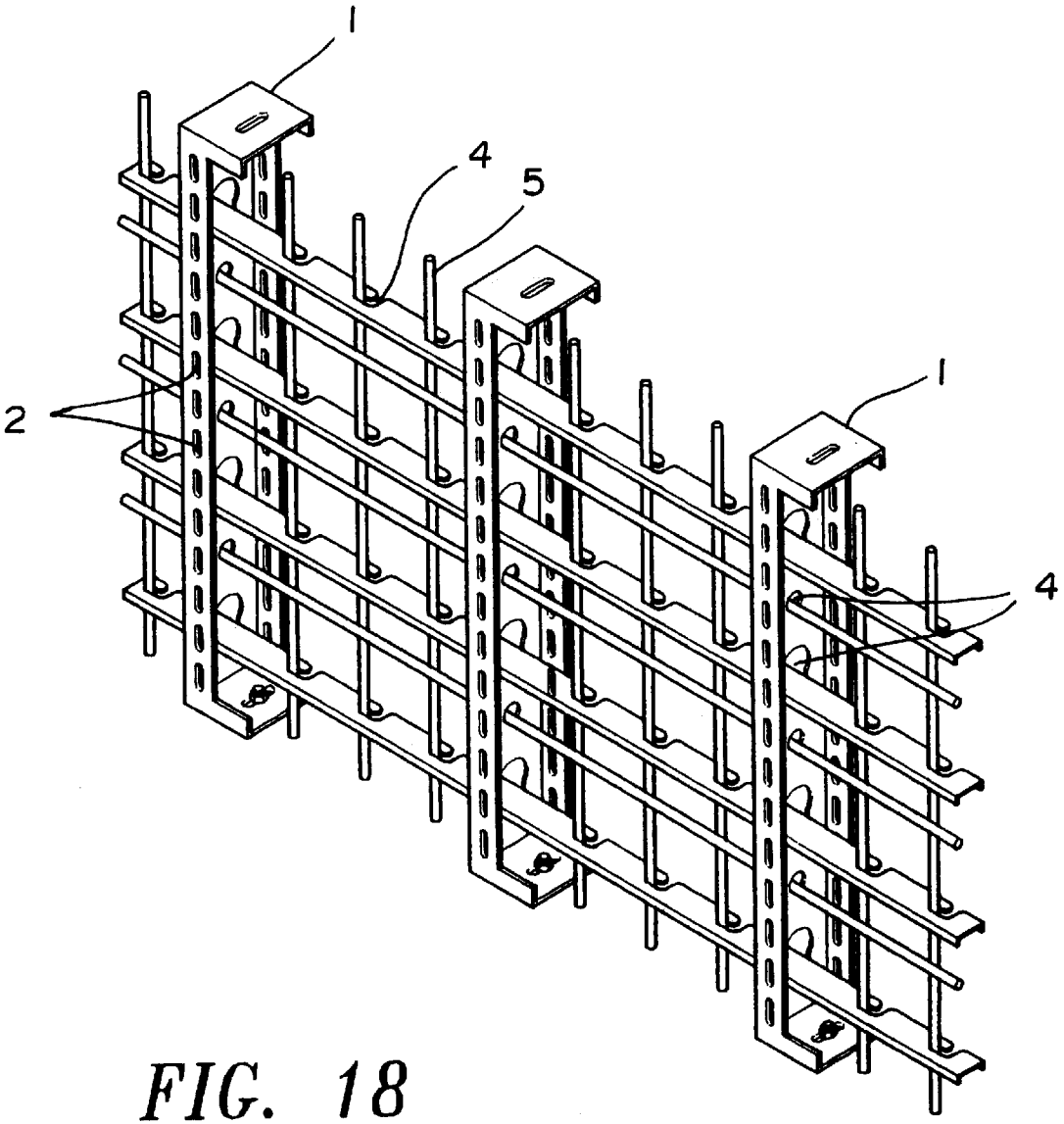
FIG. 18 is a drawing showing the inner construction according to E type assembly mode of the present invention.
Figure 19:
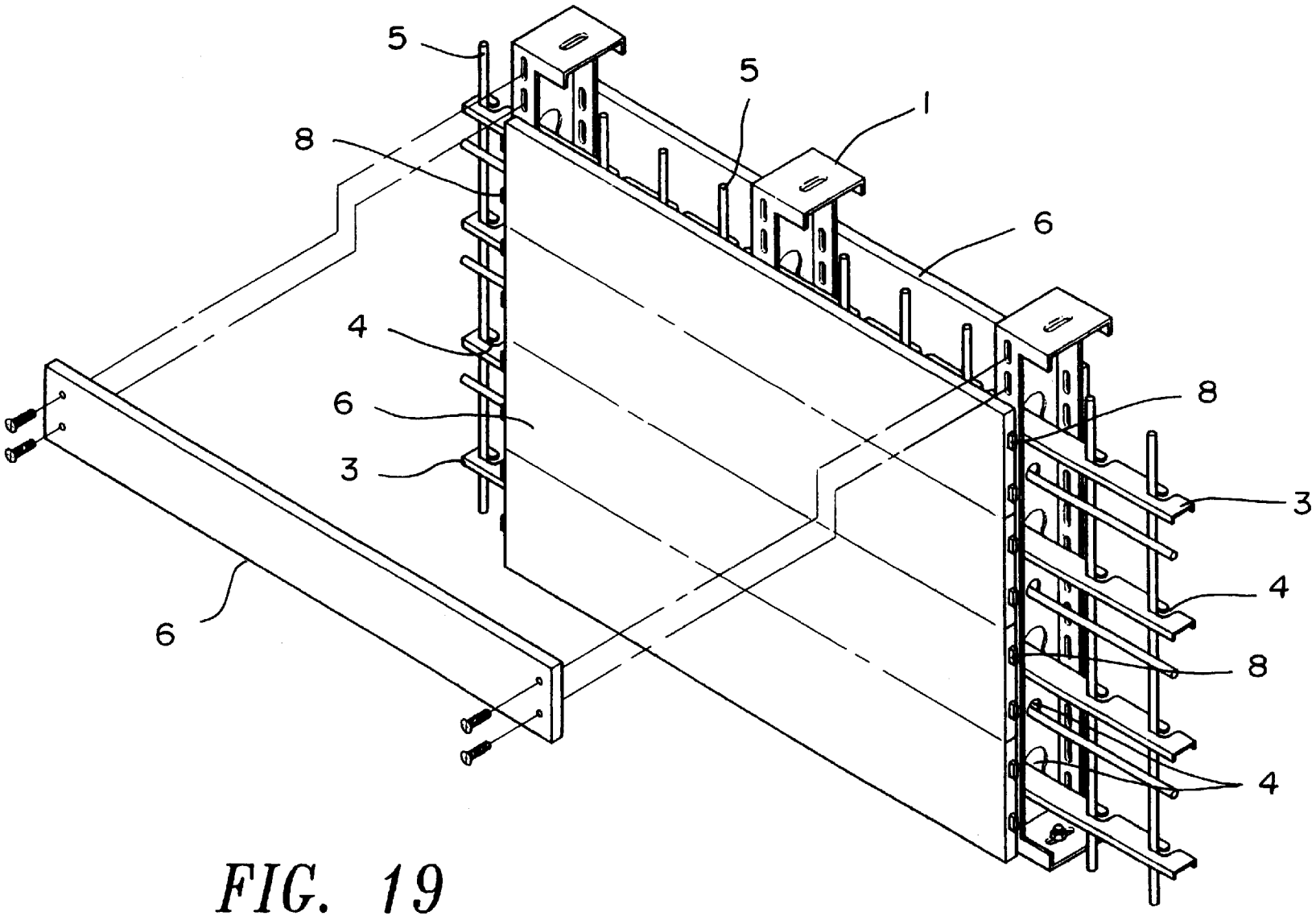
FIG. 19 is a drawing showing a completed assembly according to E type assembly mode of the present invention.

E type assembly mode:

Refereeing to FIGS. 17 through 19, the components comprised in E type assembly mode are two C shaped steel columns 1, a plurality of support frame 3, a plurality of steel bars 5, a plurality of inner and outer wall pannels 6, a plurality of T shaped pins 8, and a plurality of screws 9. The steps of E type assembly mode include: setting two C shaped steel columns 1 in a proper position; disposing the support frames 3; inserting the steel bars 5 in the fixing holes 4 provided in the supporting frames 3; inserting T shaped pins 8 into T shaped grooves 7 provided on the back surface of the inner and outer wall pannels; and tightening the T shaped pins 8 on a plurality of long holes 2 provided on both side members of C shaped steel columns 1 with screws 9. It is an essential feature of this assembly mode that main wall pannels are fixed internally but only the last pannel is fixed externally. After completion of the assembly work, all screw holes may be filled with ointment to make appearance of the finished structure better.

As mentioned in the above description, inner cavity between inner and outer walls and columns can be used to lay steel bars or to provide passages for electric and water conduits. If waste debris of marble, fire proof materials or concrete are filled in the cavity, it can serve to enhance the strength of walls and columns. If unsolidified materials are used to fill the inner cavity, those material s can be re-used should the assembly be detached for re-construction. Grouting may be accomplished in one time or divided in several times following the assembly work.

The idea involved in the present invention is exquisite, simple and progressive by making use of building wooden block principle. Every person who is an amateur in construction work can construct his own house in DIY way according to the steps illustrated and materials provided in the present invention. Moreover, the re-use of wasted materials makes a contribution to environmental protection and beautification. The re-use of wasted materials also serves to reduce the cost of construction.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. Rapidly assembled walls and columns, comprising:

inner and outer wall panels which are assembled from a group of component parts including at least one C-shaped steel column, at least one support frame with at least one fixing hole, at least one steel bar, at least one T-shaped pin, at least one tightening member, and at least one T-shaped groove; and wherein the at least one C-shaped steel column is set in a generally vertical position, the support frame is supported in a generally horizontal position by the C-shaped column, the steel bar is inserted in a generally horizontal position in the fixing hole of the support frame, the at least one T-shaped groove is formed generally horizontally on an inwardly facing surface of the inner/outer wall panel, the at least one T-shaped pin is inserted into the T-shaped groove, and the T-shaped pin is tightened to the C-shaped steel column with the at least one tightening member.

2. Rapidly assembled walls and columns according to claim 1, wherein the inner and outer wall panels are made of a material selected from the group consisting of wood, wooden scrap material, marble, limestone, tile, compressed stone powder, FRP, glass and calcium silicate; and wherein the component parts are made of a material selected from the group consisting of steel, stainless steel, aluminum alloy, reinforced plastic, carbon fiber and fire-proof plastic.

3. Rapidly assembled walls and columns according to claim 1, further comprising:

an internal cavity for receiving steel bars, providing a passage for electrical and water conduits, or filling with waste materials/debris to enhance strength.

4. An assembly method for rapidly assembling walls and columns from a group of component parts including at least one C-shaped steel column, at least one support frame with at least one fixing hole, at least one steel bar, at least one T-shaped pin, at least one tightening member, and at least one T-shaped groove, the method comprising the steps of:

setting the C-shaped steel column in a proper position;

disposing the support frame relative to the C-shaped column;

inserting the steel bar in the fixing hole of the support frame;

forming the T-shaped groove on an inwardly facing surface of the inner/outer wall panel;

inserting the T-shaped pin into the T-shaped groove; and tightening the T-shaped pin to the C-shaped steel column by extending the T-shaped pin through holes on a side of the C-shaped column and securing the T-shaped pin with the at least one tightening member.

* * * * *